US005873353A

United States Patent [19]

Makita

[11] Patent Number: 5,873,353

[45] Date of Patent: Feb. 23, 1999

[54] FUEL TREATING APPARATUS

[76] Inventor: Hideaki Makita, 6-5 Mukunoso 3-chome, Amagasaki-shi, Hyogo 661, Japan

[21] Appl. No.: 746,558

[22] Filed: Nov. 13, 1996

[30] Foreign Application Priority Data

| | | | |
|---|---|---|---|
| Jun. 7, 1995 | [JP] | Japan | 7-140898 |
| Oct. 12, 1995 | [JP] | Japan | 7-010804 U |
| Oct. 12, 1995 | [JP] | Japan | 7-010805 U |
| Dec. 6, 1995 | [JP] | Japan | 7-012914 U |

[51] Int. Cl.[6] ..... F02M 33/00

[52] U.S. Cl. ..... 123/538

[58] Field of Search ..... 123/536, 537, 123/538; 210/222, 695

[56] References Cited

U.S. PATENT DOCUMENTS

| | | | |
|---|---|---|---|
| 3,059,910 | 10/1962 | Moriya | 123/536 |
| 3,805,492 | 4/1974 | King | 123/537 |
| 5,044,346 | 9/1991 | Tada et al. | 123/538 |
| 5,055,188 | 10/1991 | Johnston et al. | 123/538 |
| 5,249,552 | 10/1993 | Brooks | 123/538 |
| 5,329,911 | 7/1994 | Jeong | 123/538 |
| 5,460,144 | 10/1995 | Park et al. | 123/538 |
| 5,487,370 | 1/1996 | Miyazaki | 123/538 |
| 5,589,065 | 12/1996 | Bogatin et al. | 123/538 |

*Primary Examiner*—Marguerite McMahon

*Attorney, Agent, or Firm*—Schweitzer Cornman Gross & Bondell LLP

[57] ABSTRACT

Apparatus for pretreating fuel for combustion in a combustor comprising a fuel line leading from a fuel supply to the combustor, said line including at least one fuel pretreatment apparatus which contains one or more of at least one ceramic piece and at least one ferromagnetic plate. The apparatus of claim 1, wherein said fuel line includes a substantially cylindrical shaped enlarged fuel pretreatment apparatus, which contains a plurality of partitions disposed therein at predetermined axial intervals each of said partitions having one or more flow through opening formed therein, whereby a undulating fuel passage is formed in said tube.

13 Claims, 8 Drawing Sheets

FUEL TREATING APPARATUS

This is a continuation of application PCT/JP96/00492, filed on Feb. 29, 1996.

FIELD OF THE INVENTION

The present invention relates to apparatus for pretreating fuel for reducing the harmful components in the exhaust, such as nitrogen oxides, carbon monoxide, and hydrocarbons, from combustors, such as vehicular or other internal combustion engines and boilers.

BACKGROUND OF THE INVENTION

In recent years, the requirements for the reduction of harmful components of combustion engine exhausts have been tightened to avoid harm to the environment. Some of the worst offending combustors are internal combustion engines of diesel trucks and other oil-fueled vehicles, and of boilers. Therefore, conventionally, such automobile engines were fitted, for example to have the exhaust pressure of the engine force air into the engine to increase the combustion efficiency. This improves the horsepower performance of the engine and also lowers fuel consumption, and decreases the harmful matter in the exhaust gas. The use of a turbocharger, however, is still not sufficient to decrease the harmful exhaust compositions. Other suggestions to reduce harmful exhaust include the use of chemical additives to the fuel oil, placing a magnet into a fuel tank, but these measures also did not lead to acceptable results.

SUMMARY OF THE INVENTION

It is an object of the present invention substantially to improve the combustion efficiency of combustors both to save on fuel consumption and to decrease the harmful matter in the exhaust gas.

The invention comprises a fuel line connected from a fuel supply to a boiler or an internal combustion engine (hereinafter collectively referred to as "combustor"). The fuel line contains connected in series a fuel pretreatment apparatus which contains at least one of a ceramic piece and of a ferromagnetic plate.

The fuel from the fuel tank to the combustor, passes through the fuel passage tube, where it contacts ceramic pieces that at ambient temperature radiate far infrared rays which subject the oil to some kind of resonance. Furthermore, the magnetism of the ferromagnetic plates also activates the oil. Thus, this activation of fuel molecules substantially improves the combustion efficiency of the fuel burned in the combustion chamber of the combustor. This saves on fuel consumption and greatly decreases the harmful components of the combustion exhaust.

Suitably the pretreatment apparatus of the present invention interposed in the fuel line tube that contains the ceramic pieces and/or the ferromagnetic plates, contains a plurality of suitably oil-resistant polytetrafluoride partitions at specified axial intervals. Each partition has a suitably located fuel flow through opening so that an undulating fuel flow path is formed in the tube. This widens the area of contact between the fuel oil passing through the undulating path and the ceramic pieces and/or ferromagnetic plates, suitably both, more intensively to activate the fuel molecules. The undulating fuel passage in the tube advantageously increases the range or path of contact between the fuel oil passing through the passage and the ferromagnetic plates.

The fuel passage pretreating apparatus of the present invention is suitably cylindrically shaped end has portions towards its ends charged with the ceramic pieces, and a more central portion that contains the ferromagnetic plates. Thus the fuel oil is first subjected to a resonant activation action by the far infrared radiation, and then activated by magnetism, and then is again subjected to the far infrared radiation further to accelerate the activation of the fuel molecules.

Suitably the fuel passage tube contains at least one filter for removing impurities, such as dust and dirt from the fuel oil.

The ferromagnetic plates are suitably wet anisotropic ferrite magnets. The strong magnetism of the wet anisotropic ferrite magnets as the ferromagnetic plates 6 can more intensively activate the fuel oil molecules.

BRIEF DESCRIPTION OF THE DRAWING

Other features and advantages are contained in the detailed description of the invention, with reference being had to the drawing, wherein.

DETAILED DESCRIPTION OF THE INVENTION

Figure 21:
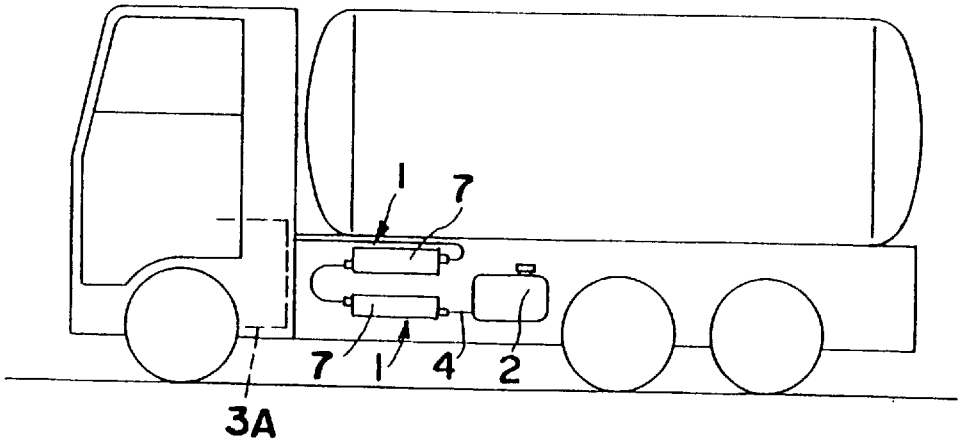
FIG. 21 is a side view showing an apparatus of the invention mounted on a diesel truck.
Figure 22:
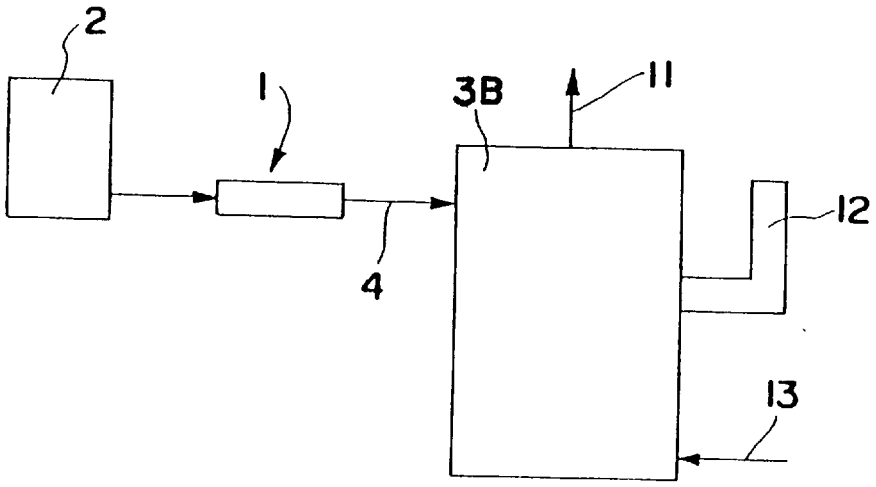
FIG. 22 is a schematic view showing an apparatus according to the invention mounted on a boiler.

FIG. 21 shows an example to which the present invention is applied. In this example, an exhaust component reducers 1 of the present invention are connected in series with a fuel oil supply line 4, between a fuel tank 2 and combustor 3A of a diesel truck. However, suitably any number of fuel pretreating exhaust reducers can be connected to each other. In FIG. 22, however an exhaust component reducer 1 of the present invention is connected in a fuel line 4 between a fuel tank 2 and a boiler 3B having a steam or vapor outlet 11, an exhaust gas outlet 12 and a water supply pipe 13.

In the first embodiment of the present invention an exhaust component reducer is shown in FIGS. 1–5, including a fuel passage tube 7, which contains or holds the ceramic pieces 5 and in the respective end portion of the fuel passage to 7, with ferromagnetic plate 6 being disposed in the center of the tube between the end portions on each side thereof.

Figure 2:
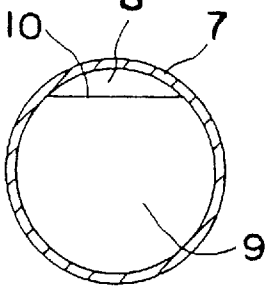
FIG. 2 is a cross-sectional view taken along line II—II of FIG. 1.
Figure 4:
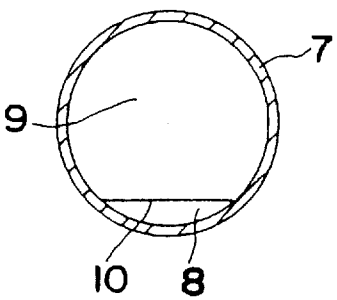
FIG. 4 is a cross-sectional view taken along line IV—IV of FIG. 1.
Figure 5:
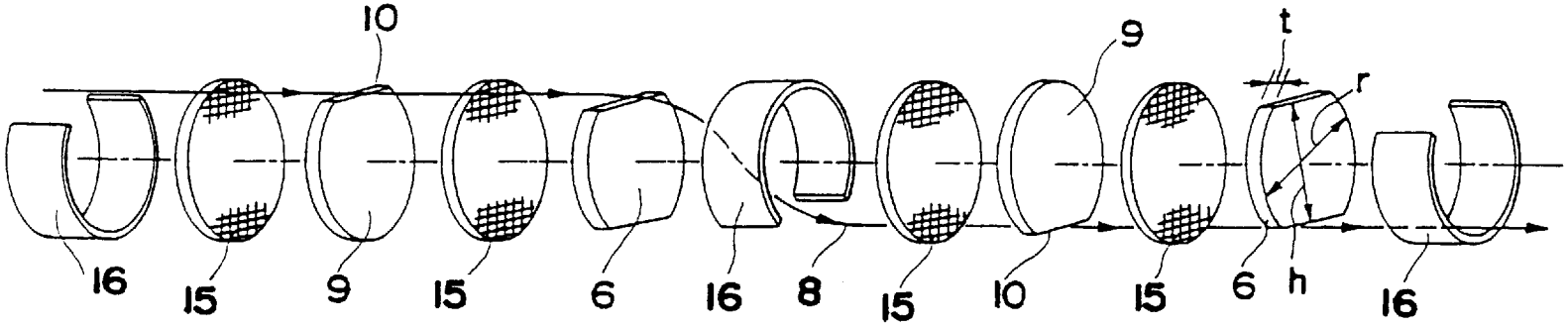
FIG. 5 is an exploded perspective view of main part of the first embodiment.

The tube 7 of the pretreating apparatus is suitably made from a stainless steel sheet or plate which is highly resistant to impact or shock and corrosion, and is comprised of parts 7A, 7B and 7C. In a suitable example, the tube 7 has a total length L of 628 mm and an outer diameter R of 101 mm. The tube 7 has an end plate 7*a*, which has an inlet 8*a* formed in it and connected to a fuel feeding supply line. The other end plate 7*b* has an outlet 8*b* formed in it and is connected to another fuel removing supply line. The tube 7 has partitions 9 placed in it at preselected axial intervals. Each partition 9 has a fuel oil flow opening or space 10 formed by cutting alternately top and bottom portions of the partitions (FIGS. 2, 4 and 5). This forms a fuel passage 8 undulating through the tube 7. The range or area of contact is thus suitably enlarged between the fuel oil passing through the fuel intake 8 and the ceramic pieces 5 and ferromagnetic plates 6. As a result, the oil molecules became activated. The partitions are suitably made of a polytetrafluoroethylene such as is sold by Du Pont Company under the trade name Teflon, which has high heat and chemical resistance, low coefficient of friction, and low level of stickiness or tackiness. Therefore, the partitions 9 will maintain the undulating fuel passage 8 and enable the smooth flow of the fuel oil.

Both end parts 7A and 7C of the tube 7 are filled with the ceramic pieces 5. The central part 7B holds the ferromagnetic plates 6 at the preselected intervals. Light oil flows through the fuel inlet 8*a* into the tube 7, and contacts the ceramic pieces 5 in the end part 7A, so that it is subjected to resonant activation by the far infrared rays omitted from the ceramic pieces 5. Then, the oil is activated by the magnetism of the ferromagnetic plates 6 in the central part 7B. Finally the oil contacts the ceramic pieces 5 in the other end portion 7C, where it is again subjected to resonant action. This assure the desired activation of light oil molecules.

The ceramic pieces 5 radiate in the far infrared at ambient temperatures, which have a wave length of from about 2 microns to about 24 microns and most suitably from about 4 to about 20 microns, and suitably have a spectral emissivity of 0.95. The ceramic pieces 5 are suitably of spherical shape as illustrated, but can also be polygonal, or have any other form. The pieces 5 contact each other at points within the fuel passage 8. The ceramic pieces 5 are suitably packed in bags 14 permitting their simple changing into and removal from the tube 7. The ceramic pieces that were found most suitable for the purposes of the invention are oxide ceramics manufactured by Naritaka Kalsushiki Koisha.

Each partition 9 is interposed between filters 15 placed over both sides of a partition. The filters 15 are made of stainless steel wire netting, and remove impurities such as dust and dirt in the light oil further to improve the combustion efficiency. The number of filters 15 can be varied as desired.

Figure 1:
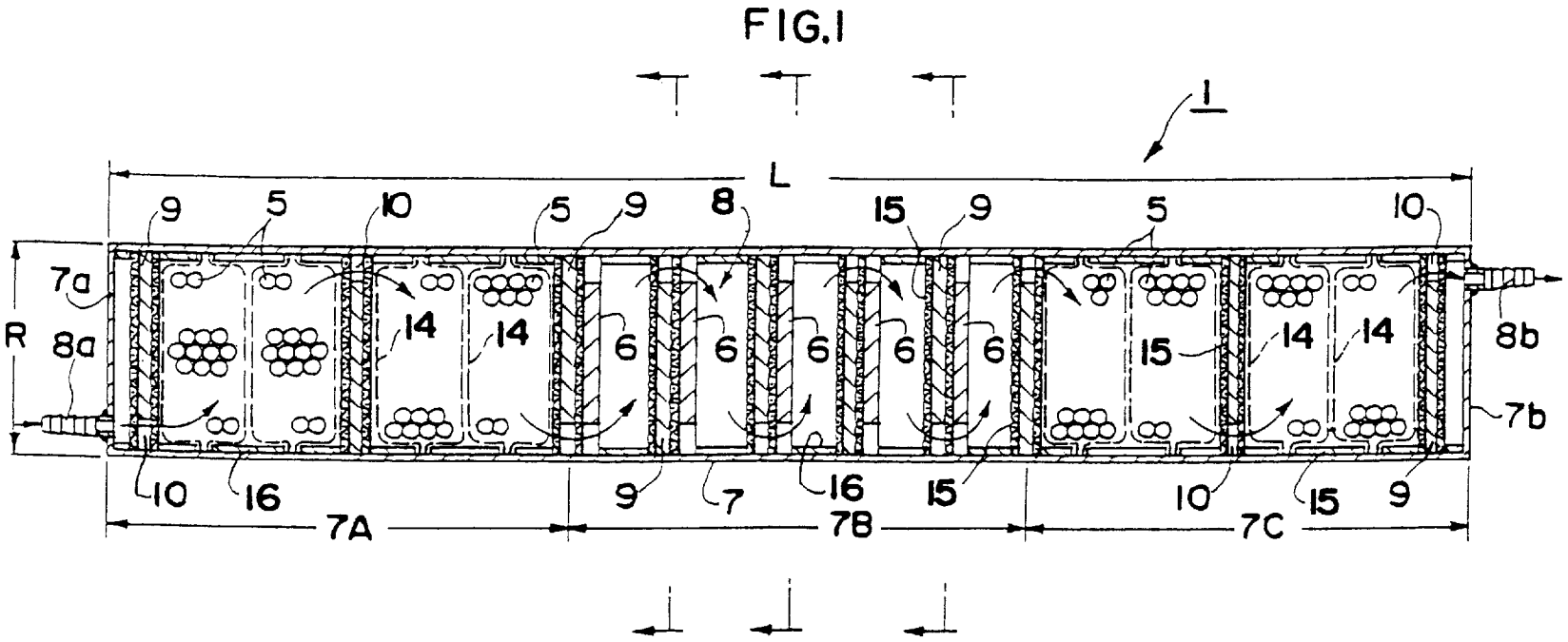
FIG. 1 is a longitudinal cross-sectional view of an exhaust gas decreasing apparatus according to a first embodiment of the present invention.
Figure 3:
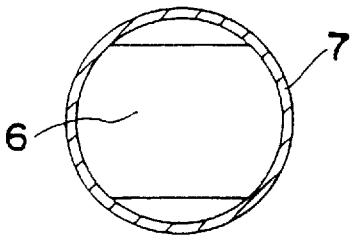
FIG. 3 is a cross-sectional view taken along line III—III of FIG. 1.

As shown in FIGS. 1, 3 and 5, the ferromagnetic plates 6 are suitably circular, and have a diameter nearly equal to the inner diameter of the tube 7. Top and bottom portions of the plates 6 are cut away to permit the flow through the light oil. In a suitable embodiment, the plates 6 have a diameter r of 95 mm, a vertical width h of 71 mm between the cut ends, and a thickness t of 5 mm. The plates 6 are made of ferromagnetic material which is suitably of the wet type aeolotropic or anisotropic of ferrite magnets. A suitable wet aeolotropic ferrite magnet material is sold under the trade designation No. SSR-420 by Sumitomo Tokushu Kinzoku. It has a residual magnetic flux density of 4.2 Br, a coercive force of 2.95 Hc and a maximum energy product of 4.2 BH. The strong magnetism of this material can activate the light oil molecules.

As best shown in FIGS. 1 and 5, positioning rings 16 are fitted on the inner peripheral surface of the tube 7, and fix the ceramic pieces 5, ferromagnetic plates 6, partitions 9 and filters 15 in their places within the tube 7.

The light oil supplied from a fuel tank 2 to the combustion chamber of an combustor 3A or a boiler 3B passes through the tube 7, where it contacts the ceramic pieces 5 which radiate in the far infrared subjecting the fuel to resonant action. In addition, the magnetism of the ferromagnetic plates further activate the oil. This action substantially improves the combustion efficiency of the light oil burned in the engine room 3A. This enables savings in the fuel consumption and greatly decreases the harmful matter in the exhaust gas.

The following test results demonstrate the extent of decrease of harmful exhaust gas by the use at this first embodiment with two exhaust reduces connected in series. An internal combustion engine manufactured by Isuzu Nainen Kikan in 1984 was used in a tank truck having a total weight of: 19,835 kg, and produced a horse power rating 275 ps, operating at a displacement of 12,011 cc.

The Exhaust Gas Density or Concentration Inspection Agency of the Juridical Foundation Nippon Nainen Kikan Kenkyusho, in Tsukuba, Ibaraki Prefecture, an inspection agency authorized by the Japanese Ministry of Tranport, conducted the tests and obtained the following results:

| Tested component | National limit | Value from inspection on apparatus of invention | Decrease |
|---|---|---|---|
| carbon monoxide | 980 ppm | 307 ppm | 69% |
| hydrocarbons | 670 ppm | 150 ppm | 78% |
| nitrogen oxides | 520 ppm | 502 ppm | 3% |

Figure 6:
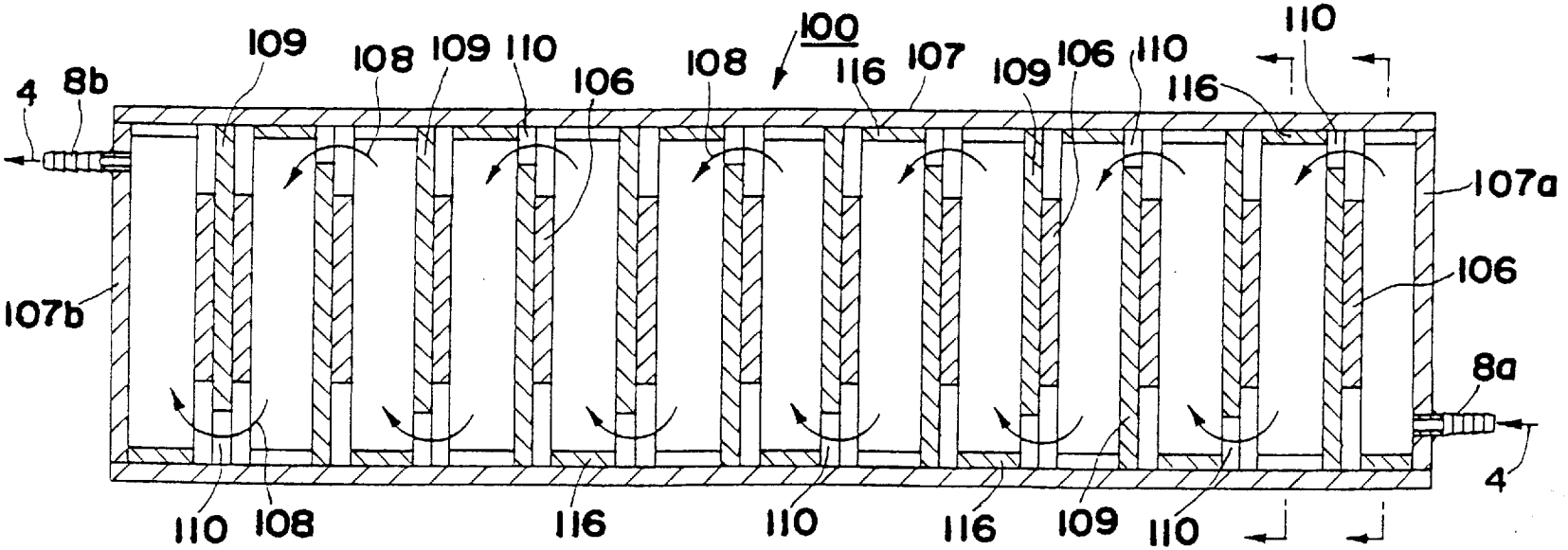
FIG. 6 is a longitudinal cross-sectional view of an exhaust gas reducer according to a second embodiment of the invention.

FIGS. 6–9 show the second embodiment of the present invention. As shown in FIG. 6, an exhaust reducer 100 according to this second embodiment of the invention includes a fuel passage tube 107, which contains ferromagnetic plates 106.

The fuel passage tube 107 is suitably made of a stainless steel or plate or sheet, which is highly resistant to impact or shock and corrosion. In a suitable embodiment, the tube 107 has a total length of 628 mm and an outer diameter of 101 mm. The tube 107 has an end plate 107*a*, which has an outlet 8*a* formed in it and connected too a fuel oil supply pipe 4. The other end plate 107*b* has an outlet 8*b* formed in it and connected with another fuel oil supply pipe 4. The tube 107 contains PTFE partitions 109 at preselected axial intervals. Each partition 109 has a fuel oil flow opening 110 formed by cutting alternately top and bottom portions of the partitions. This forms an undulating fuel passage 108 winding through the tube 107 which increases contact between the light oil passing through the passage 108 and the ferromagnetic plates 106. As a result, the light oil molecules become activated.

The ferromagnetic plates 106 are suitably placed onto the respective partitions 109, which are located at the preselected intervals in the tube 107. Light oil flows through the inlet 8*a* into the tube 107, and contacts the plurality of ferromagnetic plates 106 while flowing through the tube 107. The contact activate the molecules of the light oil, so that the molecule activation can be promoted or expedited.

The ferromagnetic plates 106 are suitably of a circular shape, and suitably have a diameter nearly equal to the inner diameter of the tube 107. Top and bottom portions of the plates 106 are cut away not to prevent the flow through of the light oil. The plates 106 can suitably have a diameter of 95 mm, a vertical width of 71 mm between the cut ends, and a thickness of 5 mm. The plates 106 are made of a ferromagnetic material, suitably of a wet aeolotropic or anisotropic ferrite magnet.

Figure 9:
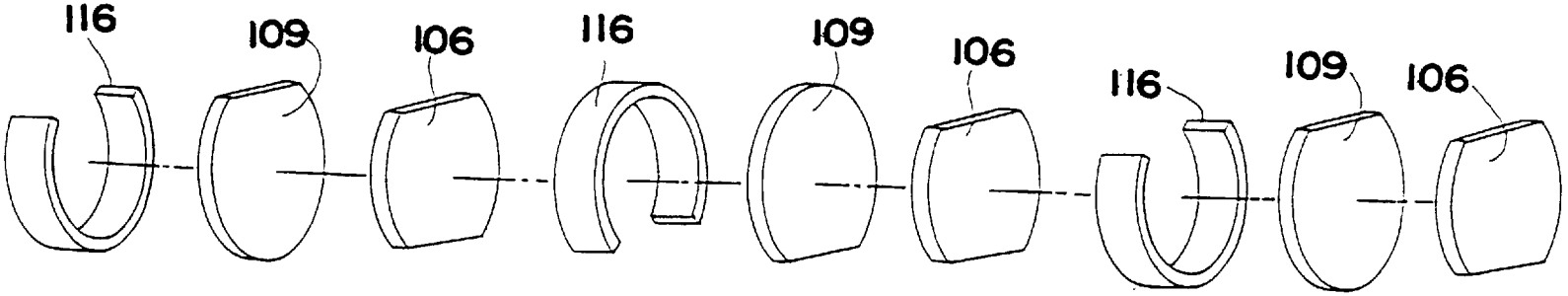
FIG. 9 is an exploded perspective view of main part of the second embodiment.

With reference to FIGS. 6 and 9, positioning rings 116 are fitted on the inner peripheral surface of the tube 107, and fix the ferromagnetic plates 106 and partitions 109 in position at preselected intervals within the fuel passage tube 107. The rings 116 are suitably split rings which are cut away adjacent to the respective fuel oil flow openings 110.

The light oil supplied from a fuel tank 2 to an engine space 3A passes through the fuel passage tube 107, where it contacts the ferromagnetic plates 106. The magnetism activates the molecules of the light oil. This remarkably improves the combustion efficiency of the light oil burned in an internal combustion engine 3A or boiler 3B, compared to the prior art. Therefore, it is possible to save on fuel consumption and greatly decrease the harmful matter in the exhaust gas.

The following experimental details demonstrate the decrease of harmful exhaust gas by the exhaust gas decreasing apparatus 100 of this second embodiment. The tests were conducted by the Exhaust Gas Density Inspection Agency, the Juridical Foundation Nippon Jidosha Kenkyusho Tsukuba, Ibaraki Prefecture, an inspection agency authorized by the Japanese Ministry of Transport, which determined that the harmful exhaust components were substantially decreased.

Test 1

1. Automobile Details
   Automobile Type: Nissan Diesel
   Total Vehicle Weight: 19,870 kg
   (horsepower: 330 ps)
   (displacement: 11,670 cc)
   Total Distance of test travel: 582,905 km
2. Inspection Results

| Tested component | National limit | Value from inspection apparatus of invention | Decrease |
|---|---|---|---|
| carbon monoxide | 980 ppm | 176.5 ppm | 82% |
| hydrocarbon | 670 ppm | 144.8 ppm | 78% |
| nitrogen oxides | 520 ppm | 449.2 ppm | 14% |

Test 2

1. Automobile Details
   Automobile Type: Mitsubishi Jidosha
   (first year registration: December 1984)
   Total Vehicle Weight: 20,000 kg
   (horsepower: 320 ps)
   (displacement: 16,031 cc)
   Total Distance of test travel: 573,711 km
2. Inspection Results

| Tested component | National limit | Value from inspection apparatus of invention | Decrease |
|---|---|---|---|
| carbon monoxide | 980 ppm | 290.6 ppm | 70% |
| hydrocarbon | 670 ppm | 228.4 ppm | 66% |
| nitrogen oxides | 520 ppm | 374.3 ppm | 28% |

Figure 10:
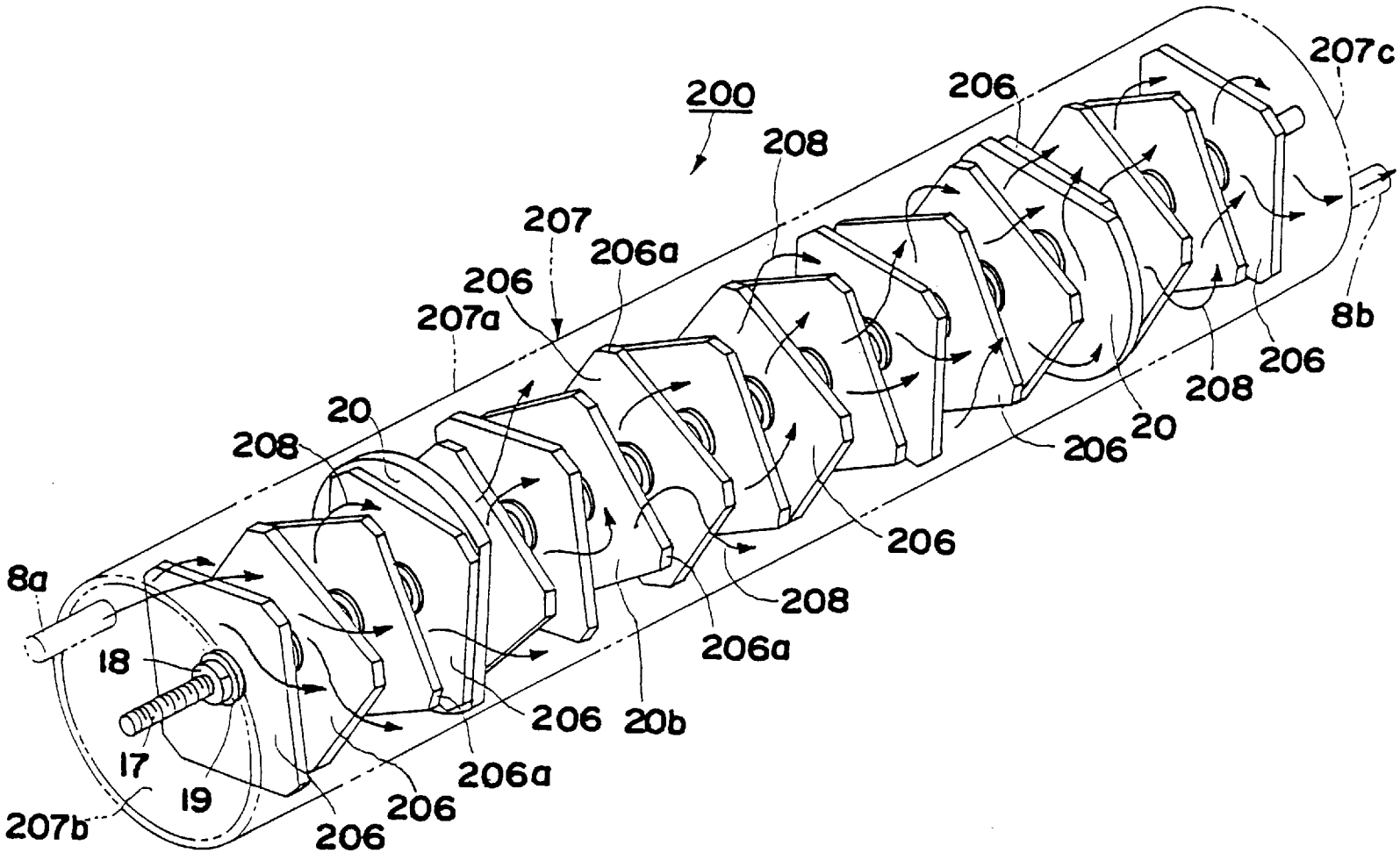
FIG. 10 is a perspective view of an exhaust gas reducer of a third embodiment of the invention.

FIGS. 10–14 shows a third embodiment of a fuel treating apparatus 200 according of the present invention. As shown in FIG. 10, the apparatus 200 includes a fuel passage tube 207, which contains ferromagnetic plates 206.

The fuel passage tube 207 can be suitably of a stainless steel sheet, which material is highly resistant to impact and corrosion. As shown in FIGS. 10–14, the tube 207 includes a cylindrical body 207*a* and end plates 207*b* and 207*c*, which close the tube at both ends. As a specific example, the body 207*a* suitably has a length of about 500 mm, an inner diameter (Din) of 134 mm, an outer diameter Dout of 140 mm, and a thickness of 3 mm. The end plates of 207*b* and 207*c* suitably have a diameter of about 134 mm and a thickness of 5 mm. The end plate 207*b* has a supply port 8*a* formed in it and connected to a fuel oil supply pipe (not shown). The other plate 207*c* has a discharge port 8*b* formed in it and connected to another fuel oil supply pipe (not shown). Each of the plates 207*b* and 207*c* has a center hole through it. A long bolt 17 extends as a fixed shaft through the center holes.

Figure 11:
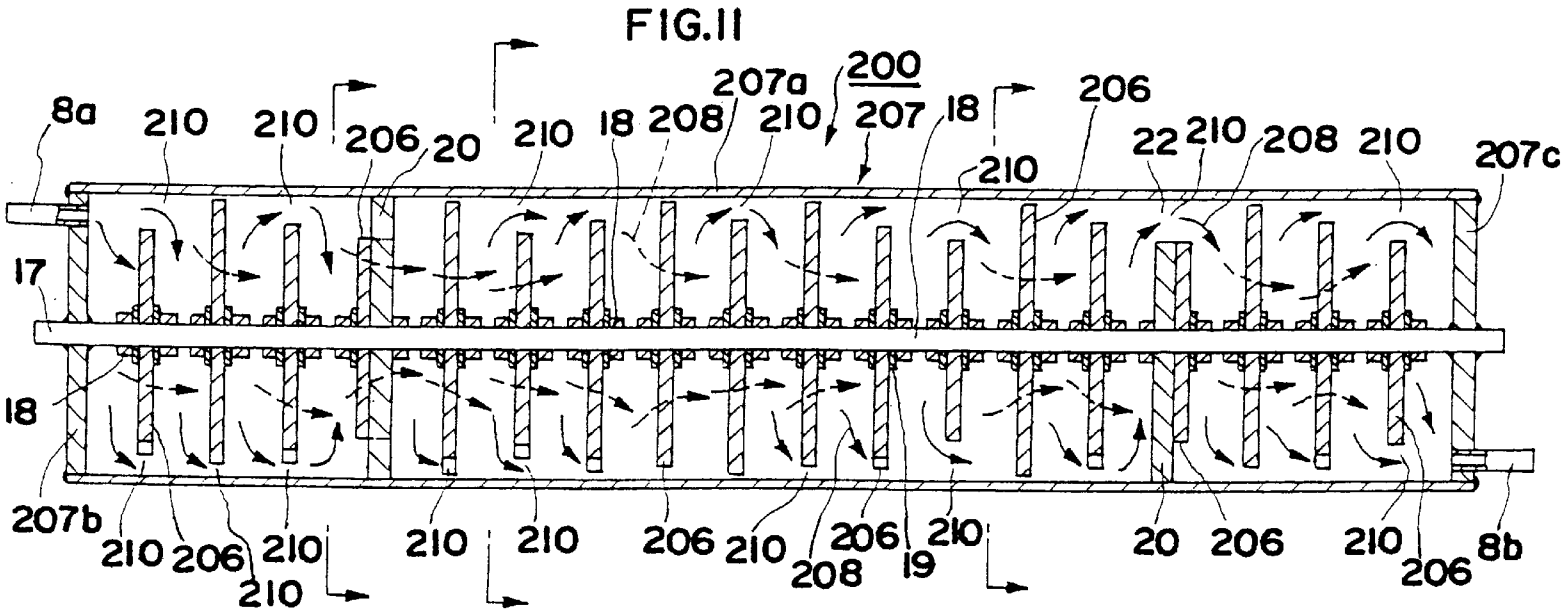
FIG. 11 is a longitudinal cross-sectional view of the apparatus of the third embodiment of the invention.

As shown in FIGS. 10 and 11, the fuel passage tube 207 contains a considerable number of ferromagnetic plates 206, suitably about 18 plates. The magnetic plates 206 are fastened to the long bolt 17 that extends through them. The plates 206 are radially mounted axially in the tube 207 at regular intervals. Each plate 206 is attached by a pair of nuts 18 through packings 19 on both sides of the plate. Suitably about two holding plates 20 are axially disposed midway of the tube 207 and nonmagnetic material. The plates 20 are fastened to the long bolt 17 that extends through them. As shown, each plate 20 is attached by nuts 18 with one side of an adjacent ferromagnetic plate 206 along side. Both end portions of the bolt 17 extend through the center holes of the end plates 207*b* and 207*c*. The holes can be suitably plugged up by welding. Alternatively, the bolt end portions can be attached by nuts through packings on both sides of each end plate 207*b*, 207*c*. The end plates 207*b* and 207*c* are suitably welded to the body 207*a*.

Figure 14:
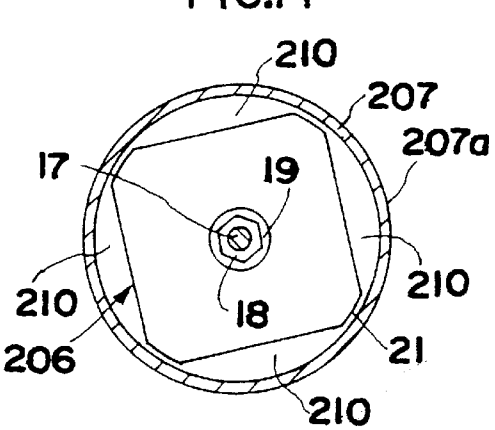
FIG. 14 is a cross-sectional view taken along line XIV—XIV of FIG. 11.
Figure 13:
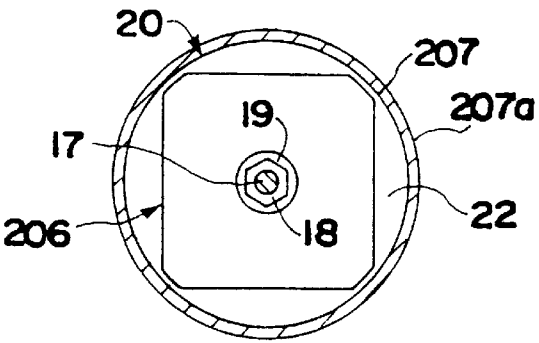
FIG. 13 is a cross-sectional view taken along line XIII—XIII of FIG. 11.
Figure 12:
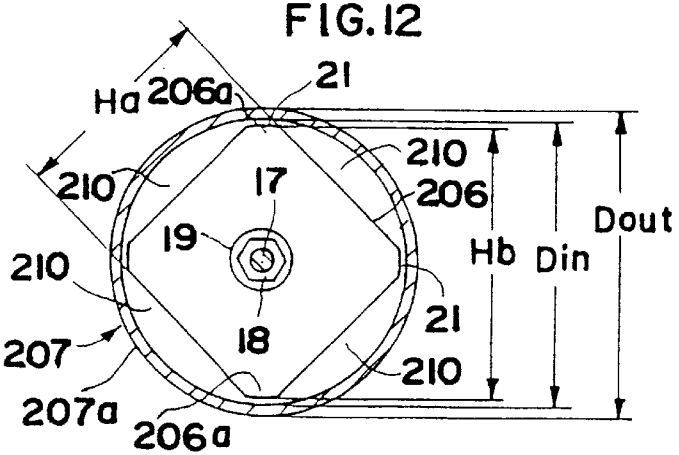
FIG. 12 is a cross-sectional view taken along line XII—XII of FIG. 11.

As shown in FIGS. 12–14, each magnetic plate 206 is generally square in front view with its corners 206*a* cut away along an arc. As a suitable example, each plate 206 can have a length Ha of 101 mm between the opposite corners, and a thickness of 4 mm. The plates 206 are made of a ferromagnetic material, which is suitably a wet type anisotropic ferrite magnet such as sold by Sumitomo Tokushu Kinzoku Material No. SSR-420 as a wet type aeolotropic ferrite magnet having residual magnetic flux density of 4.2 Br, a coercive force of 2.95 Hc and a maximum energy product of 4.2 BH. The strong magnetism of this material will securely activate the light oil molecules.

With the ferromagnetic plates 206 thus attached along the long bolt 17 in the tube 207, suitably four fuel oil flow openings, such as each having an opening 210 and a maximum width of 18 mm, and each gap 21 suitably has a clearance of about 1 mm.

As it appears from FIG. 10, the ferromagnetic plates 206 are angularly displaced around the long bolt 17 somewhat in a little sequential order. Thus the fuel oil flow openings 210 and slight gaps 21 are not completely aligned between the gaps 21 in the form of segments of a circle each formed between one straight side of each plate 206 and the inner cylindrical surface of the body 207*a*. The openings 210 and gaps 21 constitute a fuel passage 208A in the tube 207. As a result, the range of contact between the fuel oil flowing through the passage 208 and the plates 206 is greatly widened, so that the light oil molecules are activated. It is easy to insert the plates 206 into the body 207*a*, because each plate 206 is so shaped that its periphery does not contact the inner cylindrical surface of the body 207*a*. In addition, the periphery of each plate 206 can contact the light oil, so that the range of contact with the plates 206 is thus further widened. The slight gaps 21 form very small part of the fuel passage 208. Most of the light fuel oil flows through the passage 208 formed by the fuel oil flow openings 210.

The holding plates 20 prevent the tube body 207*a* from being deformed by the tightening or fastening force of a U bolt or the like, when the fuel treating apparatus of the present invention is mounted on an automobile or a boiler with the bolt or other attachment. The holding plates 20 are positioned at predetermined places lowered the center of the tube 207. As shown in FIGS. 10 and 13, a peripheral portion of each holding plate 20 is cut away to form a fuel oil flow opening or space 22 in the form of a segment of a circle between the plate 20 and the inner surface of the body 207*a* to support the body. Each plate 20 can be suitably made of polytetrafluoroethylene such as sold under the trade name Teflon by the Du Pont Company, and suitably about 5 mm thick. The holding plates 20 have sufficient strength, high heat resistance and high chemical resistance. The plates 20 also have a low friction factor and low stickiness, so that the light oil can flow smoothly past them.

In the fuel pretreating apparatus 200 of the invention, the light oil passing from a fuel tank 2 to an engine room 3A passes through the fuel passage tube 207, where it contacts the plurality of ferromagnetic plates 206. The magnetic action of the plates 206 activates the molecules of the light oil, so that the fuel oil molecules are susceptible to cleaner combustion. In the tube 207 the many ferromagnetic plates 206 are placed closely to the adjacent plates, and the fuel passage 208 and the plates 206. As a result, the range of contact between the light oil flowing through the passage 208 and the plates 206 is remarkably increased. This enables a more secure activation of the light oil molecules, which, in contrast to the prior art, substantially improves the combustion efficiency of the light oil burned in an internal combustion engine 3A or a boiler 3B. Therefore, it is possible to achieve savings in fuel consumption and a substantial decrease of harmful matter in the exhaust gas.

In the fuel pretreating apparatus 200, of the present invention, the ferromagnetic plates 206 are attached to the long bolt 17, which extends axially through them and the length of the tube 207 by mounting all in spaced relationship on the long bolt 17, and then simply inserting them into the tube 207. Thus, the incorporation of the plates 206 into the tube 207 is simple and easy. As each plate 206 is shaped so that its peripheral longer side dimensions do not contact the inner surface of the body 207*a*, the assembly can be easily inserted into the tube 207. Because each plate 206 can be fixed by the nuts 18 through the packagings 29 on its both sides, it is simple to mount the plate 206 and easy to adjust its mounting position.

The following test results demonstrate the decrease of harmful exhaust gas components, obtained by the use of the fuel pretreatment apparatus 200 according to the third embodiment of the present invention, shown in FIG. 10. All of the tests were carried out by the Exhaust Gas Density Inspection Agency, Juridical Foundation Nippon Jidosha Kenkyusho, Tsukuba, Ibaraki Prefecture, an inspection agency authorized by the Japanese Ministry of Transport.

Test 1

The test results made it clear that the present invention enables a most substantial decrease of the harmful exhaust components in the exhaust gases.

1. Automobile Details
   maker: Nissan Diesel
   engine type: PE6 Turbo
   first year registration: April, 1989
   total vehicle weight: 19,870 kg
   displacement: 11,670 cc
   total distance of test travel: 582,905 km
3.

| Tested component | National limit | Value from inspection on apparatus of invention | Decrease from limit |
|---|---|---|---|
| carbon monoxide | 980 ppm | 176.5 ppm | 82% |
| hydrocarbon | 670 ppm | 144.8 ppm | 78% |
| nitrogen oxides | 520 ppm | 449.2 ppm | 14% |

Test 2

1. Automobile Details
   maker: Mitsubishi
   engine type: 8DC9
   first year registration: December, 1988
   total vehicle weight: 20,000 kg
   displacement: 16,031 cc
   total distance of test travel: 573,711 km
2. Inspection Results

| Tested component | National limit | Value from inspection apparatus of invention | Decrease from limit |
|---|---|---|---|
| carbon monoxide | 980 ppm | 290.6 ppm | 70% |
| hydrocarbon | 670 ppm | 228.4 ppm | 66% |
| nitrogen oxides | 520 ppm | 374.3 ppm | 28% |

Test 3

1. Automobile Details
   maker: Hino engine type: WO 6D first year registration: August, 1985 total vehicle weight: 6,240 kg displacement: 5,759 cc total distance of test travel: 11,516 km 2. Inspection Results

| Tested component | National limit | Value from inspection apparatus of invention | Decrease from limit |
|---|---|---|---|
| carbon monoxide | 980 ppm | 417.2 ppm | 57% |
| hydrocarbon | 670 ppm | 289.0 ppm | 57% |
| nitrogen oxides | 520 ppm | 455.9 ppm | 12% |

Test 4

1. Automobile Details maker: Isuzu engine type: 6BG1 first year registration: September, 1986 total vehicle weight: 7,155 kg displacement: 6,494 cc total distance of test travel: 72,163 km 2. Inspection Results

| Tested component | National limit | Value from inspection apparatus of invention | Decrease from limit |
|---|---|---|---|
| carbon monoxide | 980 ppm | 197.0 ppm | 80% |
| hydrocarbon | 670 ppm | 154.0 ppm | 77% |
| nitrogen oxides | 520 ppm | 468.9 ppm | 10% |

Figure 15:
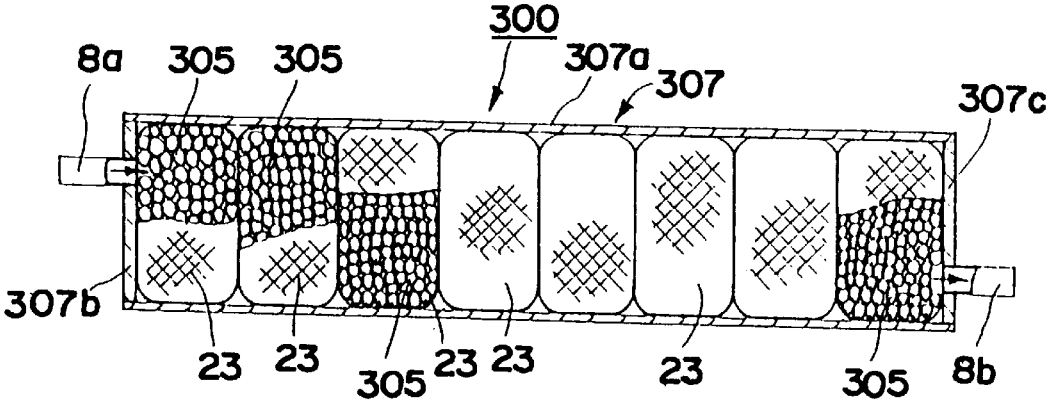
FIG. 15 is a cross-sectional view of an apparatus according to a fourth embodiment of the invention.

FIGS. 15–20 show a fourth fuel pretreatment apparatus embodiment 300 of the present invention. As shown in FIG. 15, the apparatus 300 includes a fuel passage tube 307 charged with bags filled with far infrared - radiating ceramic pieces 305.

The fuel passage tube 307 is suitably made of stainless steel plate, which is heat resistant and resistant to impact and corrosion. As shown in FIGS. 15–19, the tube 307 has a cylindrical body 307*a* and end plates 307*b* and 307*c*, which close both of its ends. Suitably the body 307*a* has about a 500 mm length, an inner diameter of about 134 mm, an outer diameter of about 140 mm, and a thickness of from about 133.6 mm to about 5 mm. The end plate 307*b* has a supply port 8*a* formed through it and connected to a fuel oil supply pipe 4. The other plate 307*c* has a discharge port 8*b* passing through it and connected to another fuel oil supply pipe 4. As shown in FIG. 15, the tube 307 is filled with mesh bags 23 packed with the ceramic pieces 305, which are spherically shaped pellets.

Figure 17:
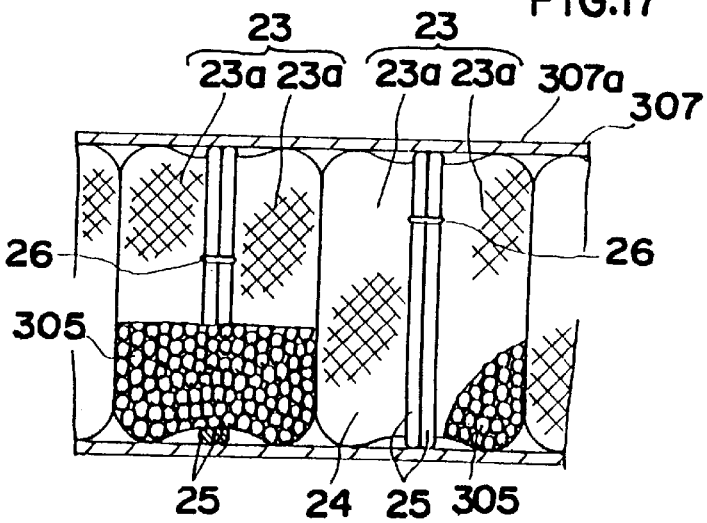
FIG. 17 is an enlarged and detailed view of part of the apparatus shown in FIG. 15.
Figure 18:
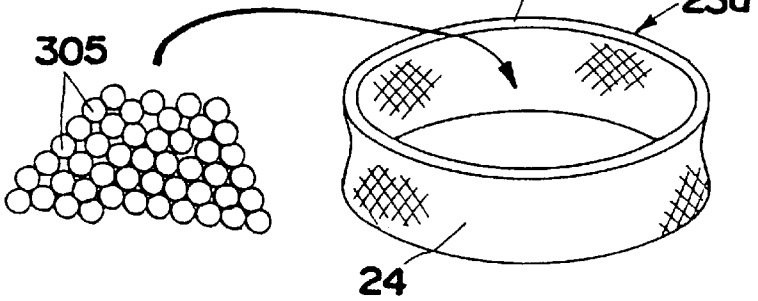
FIG. 18 is a perspective view showing a half of a mesh bag and the ceramic pieces for filling it.

As shown in FIGS. 17 and 18, each mesh bag 23 has two half portions 23*a*. Each half 23*a* is of a stainless mesh 24 shaped like a cup, and is provided with a reinforcing stainless ring 25 fixed to the rim of the mesh half bag 24. The diameter of the ring 25 is selected so that it can be easily fitted into the tube body 307*a*. Each bag 23 can be charged with ceramic pieces 305, then attaching the halves 23*a* to each other to close the loop, and finally joining the rings 25 with stainless wires 26 and thus bagging the pieces 305 as shown in FIG. 17. The body 307*a* can then be packed with the bags 23 thus filled with the ceramic pieces 305.

Figure 8:
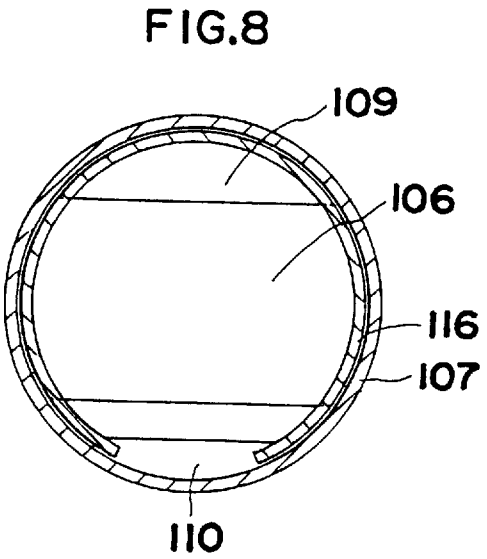
FIG. 8 is a cross-sectional view taken along line VIII—VIII of FIG. 6.
Figure 7:
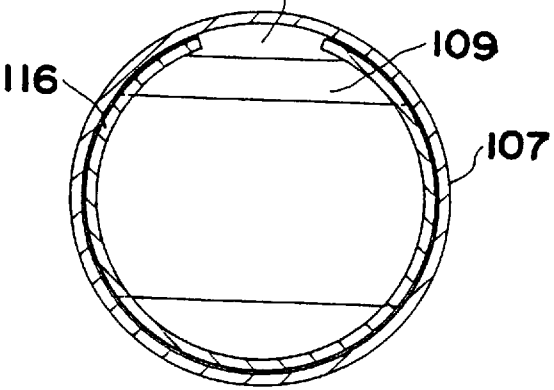
FIG. 7 is a cross-sectional view taken along line VII—VII of FIG. 6.
Figure 16:
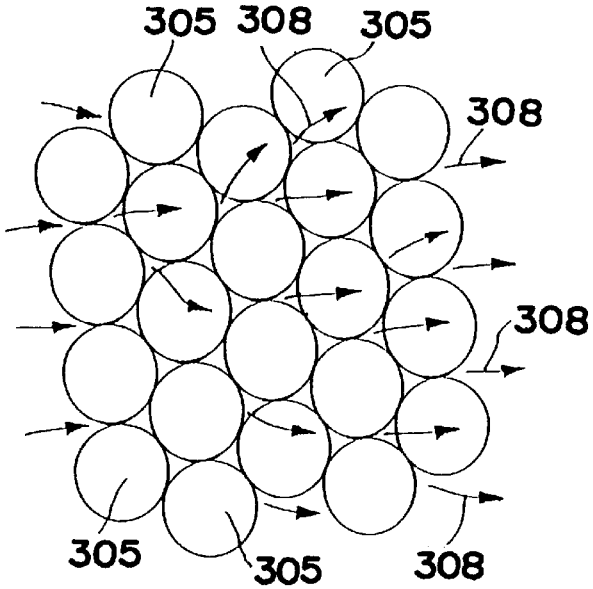
FIG. 16 is an enlarged view of far infrared ceramic pieces loaded into the tubular case of the fourth embodiment of the apparatus.

The ceramic pieces 305 can radiate in the far infrared at normal temperature, which having a wave length of from about 4 to about 24 micrometers, and an average emissivity of about 0.8 (FIG. 8). The pieces 305 have a diameter of 7 to about 8 mm, and are suitably oxide ceramic bodies sold by Noritake Kabushiki Kaisha. As shown in FIG. 16, the pieces 305 bagged and packed into the tube 307 contact at points with the adjacent ones, so that fuel passages 308 are formed among the pieces 305.

In using the fuel pretreatment apparatus 300 of the present invention, light oil is supplied from a fuel tank 2 to an engine room 3A through the fuel passage tube 307. As shown in FIG. 15, the oil enters the tube 307 through the supply port 8*a*. Then, as shown in FIG. 16, the oil flows through the fuel passages 308 among the ceramic pieces 305, and is discharged through the exit port 8*b*. The oil, while flowing through the passages 308, contacts the ceramic pieces 305 as they radiate in the far infrared. This subjects the oil to resonant action and activates the light oil molecules. This activation molecules remarkably improves the combustion efficiency of the light oil burned in the engine room 3A over that was obtainable without it. This enables substantial savings in fuel consumption and greatly decrease the harmful components in the engine exhaust.

In the fuel pretreatment apparatus 300, the fuel passage tube are charged with the mesh bags 23, which are filled with the ceramic pieces 305. It is therefore simple and easy to charge the tube 307 with the pieces 305 and to take them out. Due to the suitably spherical shape of the ceramic pieces 305, the fuel passages 308 are formed between them so securely that the light fuel oil continues to flow through the charge of ceramic pieces. In addition, the oil also contacts the spherical pieces 305 so effectively that it is sufficiently exposed to the far infrared radiation for complete fuel activation.

The following tests the decrease of harmful exhaust gas effected by this fourth embodiment. The tests were carried out by the Exhaust Gas Density Inspection Agency, Juridical Foundation Nippon Nainen Kikan Kenkyusho Tsukuba, Ibaragi Prefecture, an inspection agency authorized by the Japanese Ministry of transport.

1. Engine Details engine maker: Isuzu vehicle tpe: Tank Truck first year registration: December, 1984 total vehicle weight: 19,835 kg (275 ps horse power:)

displacement: 12,011 cc

2. Inspection Results

| Tested component | National limit | Value from inspection apparatus of invention | Decrease from limit |
|---|---|---|---|
| carbon monoxide | 980 ppm | 307 ppm | 69% |
| hydrocarbon | 670 ppm | 150 ppm | 78% |
| nitrogen oxides | 520 ppm | 402 ppm | 3% |

As is apparent from the above test inspection results, the present invention enabled a substantial reduction of the harmful components in the exhaust gas.

Figure 19:
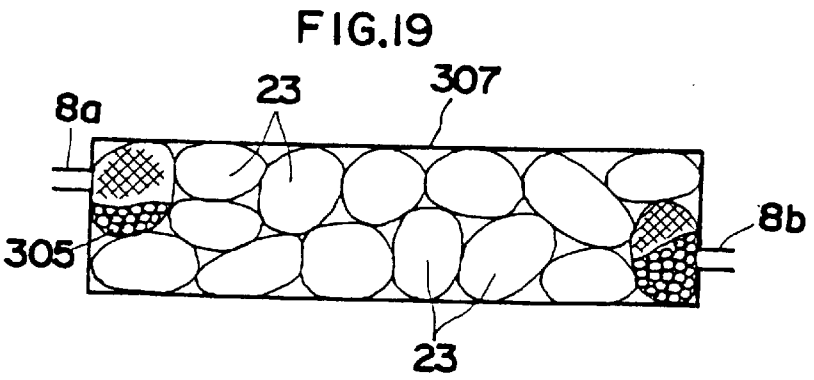
FIG. 19 is a cross-sectional view showing a slight modification of the fourth embodiment.

In the embodiment shown in FIG. 15, each mesh bag 23 filled with the ceramic pieces 305 is dimensional nearly to the inner diameter of the tube 307. The bags 23 are best shown in FIG. 19. The tube 307 can be packed suitably with relatively small mesh bags 23A filled with ceramic pieces 305.

Figure 20:
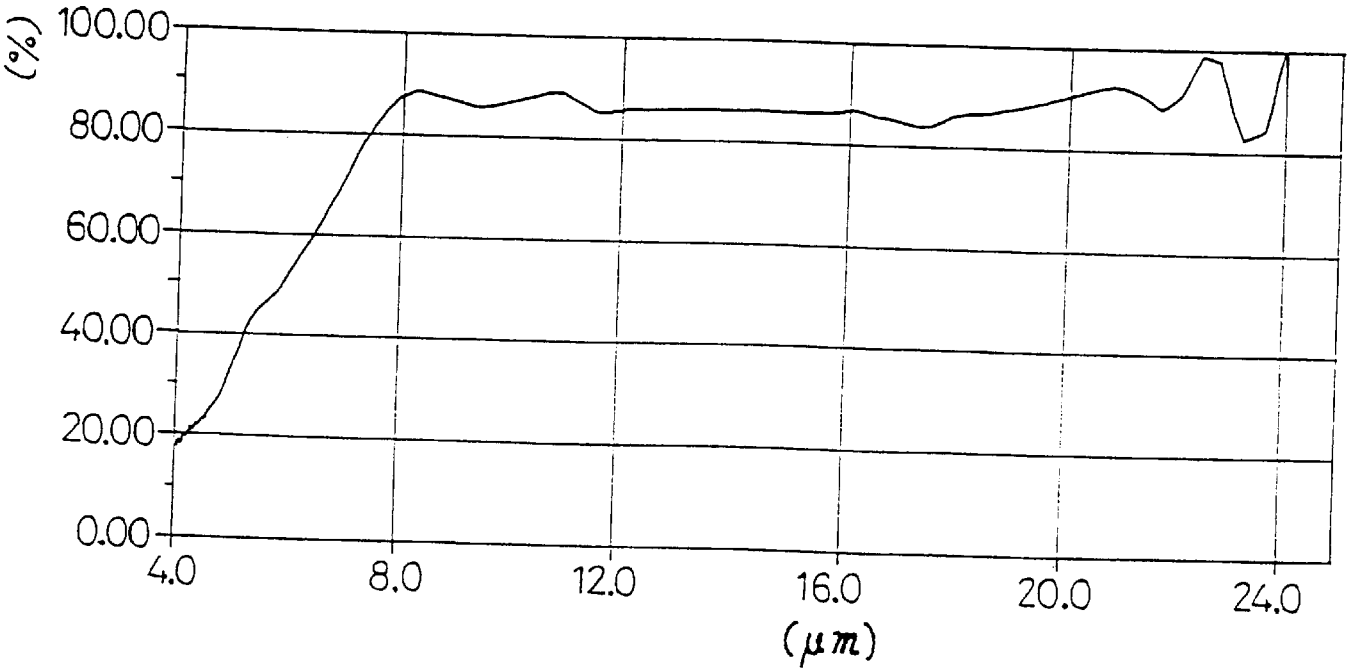
FIG. 20 is a graph showing results of a measurement for the far infrared emissivity of the ceramic pieces plotting, wavelength, as a function of emissivity.

FIG. 20 shows results of a measurement for the far infrared emissivity of the ceramic pieces 305 used in the above embodiment. The average emissivity at a wave length of from about 4 to about 24 micrometers was 76.1%. The test was carried out by Kawatetsu Techno-research Kabushiki Kaisha with the following details.

1. Samples or Specimens 200 g of white oxide ceramic balls made by Noritake Kabushiki Kaisha 2. Measuring Conditions 1) Apparatus: FT-IR made by Nippon Denshi Kabushiki Kaisha 2) Measuring temperature: About 150 degrees C.

3) Measuring Method: Measuring method by two-point temperature standard

4) Temperature Measuring Method: Measuring with a thermo (electric) couple tip put slightly into the powder surface.

5) Reference (light): Blackbody furnace action in the magnetism of the ferromagnetic plates.

As it is apparent from the above description, the fuel oil supplied from a fuel tank to an internal combustion engine or to a boiler passes through the fuel passage tube, of the fuel pretreatment device of the present invention where it contacts the ceramic pieces and/or ferromagnetic plates. The ceramics pieces radiate in the far infrared domain, exposure to which subject the oil to resonation and a resulting activation of domains of the fuel oil molecules. If the oil contacts both the ceramic pieces and the ferromagnetic plates, it is subjected to both kinds of activating both actions. This can, as compared with the prior art, remarkably improve the combustion efficiency of the fuel oil burned in the engine room or boiler combustion chamber. Thus it is possible to save on fuel consumption and greatly decrease the harmful components in the exhaust gas.

I claim:

1. A cylindrically shaped fuel pretreatment apparatus for providing fuel for combustion in a combustor wherein a fuel line having a diameter and leading from a fuel supply to the combustor is interrupted in series by the fuel pretreatment apparatus which comprises ceramic pieces adapted to radiate in the far infrared portion of the electromagnetic spectrum, or a ferromagnetic plate, or both ceramic pieces and a ferromagnetic plate, the cylindrical shape having a substantially larger diameter than the diameter of the fuel line, the apparatus containing a plurality of partitions disposed therein at predetermined axial intervals, each of said partitions having one or more flow through opening forming an undulating fuel passage in said apparatus.

2. The apparatus of claim 1, the apparatus having a central portion containing a ferromagnetic plate, and end portions at both axial ends of said central portion, said end portions being charged with ceramic pieces adapted to radiate in the far infrared portion of the spectrum.

3. The apparatus of claim 1 wherein said fuel pretreatment apparatus contains at least one filter.

4. The apparatus of claim 2, wherein said ferromagnetic plate is of an aeolotropic ferrite.

5. The apparatus of claim 1, wherein the fuel line has a diameter, and the apparatus having a substantially cylindrical shape with a substantially larger diameter than that of said fuel line, the fuel pretreatment apparatus containing said ferromagnetic plate, a plurality of partition separators at preselected intervals axially spaced from each other defining separate partitions therebetween, said partitions each having a fuel flow opening formed therein arranged to form an undulating fuel passage.

6. The apparatus of claim 5, wherein said partition separators in the apparatus are made of polytetrafluoroethylene.

7. The apparatus of claim 1, wherein the fuel line has a diameter, and the pretreatment apparatus is cylindrically shaped with a substantially larger diameter than that of said fuel line, the apparatus containing a plurality of ferromagnetic plates which are radially extending within said cylindrical shape, a shaft disposed lengthwise within said cylindrical apparatus with said ferromagnetic plates being attached to said shaft at preselected spaced intervals, and flow-through openings between said ferromagnetic plates, said openings being disposed along an interior wall of the cylindrical apparatus to form a fuel passage for the flow-through of the fuel through said cylindrical apparatus.

8. The apparatus of claim 7, wherein said flow through openings are angularly displaced relative to an adjacent opening for forming a fuel flow passage.

9. The apparatus of claim 8, wherein said ferromagnetic plates have peripheral portions spaced from the interior wall of said cylindrical apparatus for forming fuel flow through openings by said spaced portions, a supporting plate of a nonmagnetic material attached to said shaft so that at least part of its peripheral portion is spaced from said interior surface for providing an oil flow through.

10. The apparatus of claim 9, wherein said supporting plate is of a polytetrafluoroalkyl resin.

11. The apparatus of claim 7 wherein said shaft is a long bolt extending through said ferromagnetic plates, the apparatus further comprising packings and nuts at both sides of said ferromagnetic plates for attaching them to said shaft.

12. The apparatus of claim 1, wherein said ceramic pieces in the apparatus are packed in a plurality of mesh bags.

13. The apparatus of claim 12, wherein said ceramic pieces are spherical in shape.

* * * * *